US011645986B2

(12) United States Patent
Goto et al.

(10) Patent No.: US 11,645,986 B2
(45) Date of Patent: May 9, 2023

(54) IMAGE PROCESSING DEVICE THAT INCREASES VARIATIONS IN DISPLAY CHARACTERISTICS OF DISPLAY DEVICE

(71) Applicant: Sharp Kabushiki Kaisha, Sakai (JP)

(72) Inventors: Naoko Goto, Sakai (JP); Makoto Shiomi, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/832,739

(22) Filed: Jun. 6, 2022

(65) Prior Publication Data

US 2022/0392415 A1 Dec. 8, 2022

(30) Foreign Application Priority Data

Jun. 8, 2021 (JP) ..... JP2021-095528

(51) Int. Cl.
*G09G 3/34* (2006.01)
*G09G 3/36* (2006.01)

(52) U.S. Cl.
CPC ..... *G09G 3/3426* (2013.01); *G09G 3/3648* (2013.01); *G09G 2300/023* (2013.01); *G09G 2320/0646* (2013.01); *G09G 2360/16* (2013.01)

(58) Field of Classification Search
None
See application file for complete search history.

(56) References Cited

U.S. PATENT DOCUMENTS

2016/0042701 A1* 2/2016 Furumoto ..... G02F 1/1347 345/694
2016/0379575 A1* 12/2016 Kawai ..... G09G 3/3611 345/694

FOREIGN PATENT DOCUMENTS

JP 2018-054679 A 4/2018

* cited by examiner

*Primary Examiner* — Chad M Dicke
(74) *Attorney, Agent, or Firm* — Keating & Bennett, LLP

(57) ABSTRACT

An image processing device generates backlight data from input image data to control outputs of a plurality of light-emitting regions; corrects the backlight data; generates luminance distribution data for the backlight from the backlight data that is corrected; generates second panel data from an input image data to control aperture ratios of a plurality of pixels; corrects the second panel data; generates luminance distribution data for the second liquid crystal panel from the second panel data that is corrected and the luminance distribution data for the backlight; and generates first panel data from the input image data and the luminance distribution data for the second liquid crystal panel to control aperture ratios of a plurality of picture elements.

8 Claims, 9 Drawing Sheets

IMAGE PROCESSING DEVICE THAT INCREASES VARIATIONS IN DISPLAY CHARACTERISTICS OF DISPLAY DEVICE

CROSS-REFERENCE TO RELATED APPLICATION

The present application claims priority from Japanese Application JP 2021-095528, the content to which is hereby incorporated by reference into this application.

TECHNICAL FIELD

The present disclosure relates to image processing devices.

BACKGROUND ART

In recent years, a display panel unit has been developed that includes three layers of a color liquid crystal panel, a monochrome liquid crystal panel, and a backlight as disclosed in Japanese Unexamined Patent Application Publication No. 2018-054679. A liquid crystal display device includes an image processing device that enables such a display panel unit to display an image.

The image processing device transmits control data to each of the color liquid crystal panel, the monochrome liquid crystal panel, and the backlight separately. The image processing device enables the display panel unit to display an image on the basis of the three types of control data transmitted to the three respective layers.

SUMMARY

According to the technology disclosed in Japanese Unexamined Patent Application Publication No. 2018-054679 described above, the control data for the backlight is determined on the basis of a maximum luminance of those subpixels in the color liquid crystal panel which are in a virtual region opposite one of the light-emitting regions of the backlight. In addition, the control data for specifying an aperture ratio for a subsequent panel is determined on the basis of previously determined control data, in the order of the backlight, the color liquid crystal panel, and the monochrome liquid crystal panel. Therefore, there is a low degree of freedom in selecting a combination of the three types of control data.

On the other hand, there are intrinsically numerous combinations of the three types of control data. In other words, it is considered that there should be a high degree of freedom in selecting a combination of the three types of control data. Therefore, it should be possible to increase variations in the display characteristics of the liquid crystal display device in accordance with the selected three types of control data.

However, according to the control method for the liquid crystal display device disclosed in Japanese Unexamined Patent Application Publication No. 2018-054679 described above, it is not possible to obtain an effect of increasing variations in the display characteristics by utilizing the high degree of freedom in selecting a combination of the three types of control data. Therefore, the capability of the liquid crystal display device including the three layers is not thoroughly exploited.

The present disclosure has been made in view of the above-described problem and its object is to provide an image processing device that enables to increase variations in the display characteristics of a liquid crystal display device.

The present disclosure is directed to an image processing device that has a display panel unit display an image, the display panel unit including: a first liquid crystal panel including a plurality of picture elements; a second liquid crystal panel opposite the first liquid crystal panel and including a plurality of pixels; and a backlight opposite the second liquid crystal panel and having a plurality of light-emitting regions, the image processing device including: a backlight data generation unit configured to generate backlight data from input image data to control outputs of the plurality of light-emitting regions; a backlight data correction unit configured to correct the backlight data; a backlight luminance distribution generation unit configured to generate luminance distribution data for the backlight from the backlight data that is corrected; a second panel data generation unit configured to generate second panel data from the input image data to control aperture ratios of the plurality of pixels; a second panel data correction unit configured to correct the second panel data; a second panel luminance distribution generation unit configured to generate luminance distribution data for the second liquid crystal panel from the second panel data that is corrected and the luminance distribution data for the backlight; and a first panel data generation unit configured to generate first panel data from the input image data and the luminance distribution data for the second liquid crystal panel to control aperture ratios of the plurality of picture elements.

DESCRIPTION OF EMBODIMENTS

Figure 1:
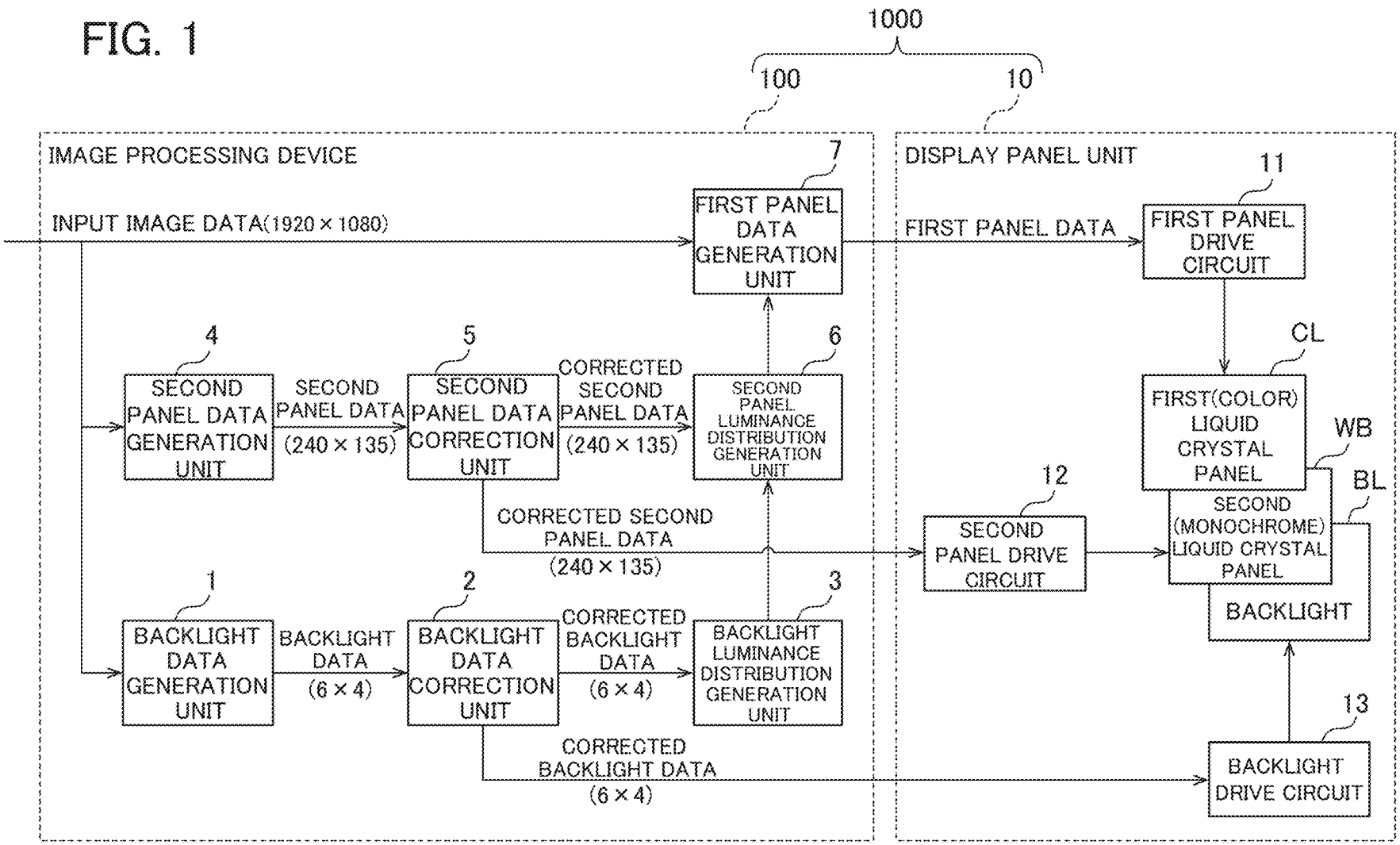
FIG. 1 is a comprehensive block diagram of a liquid crystal display device that is common to all embodiments.

The following will describe an image processing device in accordance with the present disclosure with reference to drawings. Identical and equivalent elements are denoted by the same reference numerals throughout the drawings, and description thereof is not repeated.

Embodiment 1

FIG. 1 is a comprehensive block diagram of a liquid crystal display device 1000. In FIG. 1, the rear end of an arrow indicates a sender of data, and the front end of an arrow indicates a destination of data.

Referring to FIG. 1, the liquid crystal display device 1000 includes a display panel unit 10 and an image processing device 100 for controlling the display panel unit 10. The display panel unit 10 and the image processing device 100 are physically integrated in the liquid crystal display device 1000 in accordance with the present embodiment. The display panel unit 10 and the image processing device 100 may be however physically separated insofar as they are connected to each other in a communicable manner.

The display panel unit 10 includes a first liquid crystal panel CL, a first panel drive circuit 11, a second liquid crystal panel WB, a second panel drive circuit 12, a backlight BL, and a backlight drive circuit 13.

The first liquid crystal panel CL (see FIG. 2) is a so-called color liquid crystal panel capable of color displays. The first liquid crystal panel CL includes a plurality of pixels 1PX (see FIG. 5). Each pixel 1PX includes a plurality of subpixels. A subpixel is referred to as a picture element PE (see FIG. 5) in the present specification. Each pixel 1PX includes a picture element PE (R), a picture element PE (G), and a picture element PE (B). The picture element PE (R) includes a red color filter and transmits red light. The picture element PE (G) includes a green color filter and transmits green light. The picture element PE (B) includes a blue color filter and transmits blue light.

The combination of color filters for the plurality of picture elements PE in each pixel 1PX in the first liquid crystal panel CL is not necessarily limited to a red, a green, and a blue color filter. As an alternative example, the combination may be a yellow, a magenta, and a cyan color filters. The plurality of picture elements PE in the first liquid crystal panel CL have a resolution of, for example, 1,920×1,080 for each color.

The first panel drive circuit 11 drives each liquid crystal layer in the plurality of picture elements PE in the first liquid crystal panel CL in such a manner that each of the plurality of picture elements PE can have the aperture ratios specified by first panel data generated by the image processing device 100. In the present specification, the "aperture ratio" of the picture element PE refers to the actual opening area of the picture element PE as opposed to a maximum opening area of the picture element PE.

Figure 2:
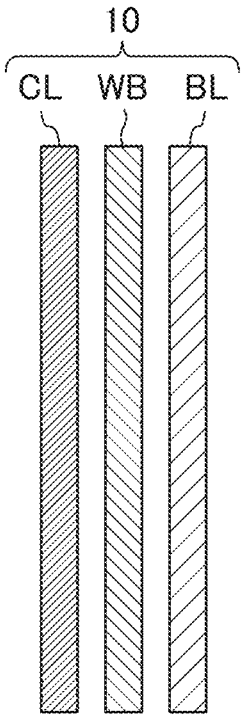
FIG. 2 is a schematic cross-sectional view of a display panel unit in the liquid crystal display device that is common to all embodiments.

The second liquid crystal panel WB is a so-called monochrome liquid crystal panel capable of black and white displays (see FIG. 2). The second liquid crystal panel WB includes a plurality of pixels 2PX (see FIG. 4). None of the plurality of pixels 2PX has a color filter. The plurality of pixels 2PX serve as openings for adjusting how much of the light emitted by the backlight BL is transmitted. The plurality of pixels 2PX have a variable opening area. The second liquid crystal panel WB is located opposite the first liquid crystal panel CL. The plurality of pixels 2PX in the second liquid crystal panel WB have a resolution of, for example, 240×135. The pixel 2PX may include subpixels in the second liquid crystal panel WB.

The second panel drive circuit 12 drives each liquid crystal layer in the plurality of pixels 2PX in the second liquid crystal panel WB in such a manner that the plurality of pixels 2PX can have the aperture ratios specified by corrected second panel data generated by the image processing device 100. In the present specification, the "aperture ratio" of the pixel 2PX refers to the actual opening area of the pixel 2PX as opposed to a maximum opening area of the pixel 2PX.

The backlight BL is located opposite the second liquid crystal panel WB (see FIG. 2). The backlight BL has a plurality of light-emitting regions LER (see FIG. 3). The light-emitting regions LER of the backlight BL have a resolution of, for example, 6×4. Each light-emitting region LER has a plurality of LEDs (light-emitting diodes). The plurality of LEDs are controlled in such a manner that the plurality of LEDs in each light-emitting region LER have the same luminescent mode so that the whole light-emitting region LER can emit substantially uniform light. Local dimming is performed where the amount of light emitted is controlled independently for each of the plurality of light-emitting regions LER.

The backlight drive circuit 13 drives each of the plurality of light-emitting regions LER of the backlight BL in such a manner that the plurality of light-emitting regions LER can make the outputs specified by corrected backlight data generated by the image processing device 100.

The image processing device 100 has the display panel unit 10 display an image on the basis of externally fed input image data. The input image data has a resolution of 1,920×1,080, which is equal to the resolution of the plurality of picture elements PE. The input image data can specify a plurality of input gray scales for each of the plurality of picture elements PE in the first liquid crystal panel CL. The input image data can specify an input image by way of a plurality of input gray scales. The input image specified by the input image data is an equivalent of the output image displayed on the display panel unit 10.

The image processing device 100 includes a backlight data generation unit 1, a backlight data correction unit 2, a backlight luminance distribution generation unit 3, a second panel data generation unit 4, a second panel data correction unit 5, a second panel luminance distribution generation unit 6, and a first panel data generation unit 7. The backlight data generation unit 1, the backlight data correction unit 2, the backlight luminance distribution generation unit 3, and the second panel data generation unit 4 in the present embodiment are all implemented by electronic circuitry dedicated to image processing in accordance with the present embodiment. The second panel data correction unit 5, the second panel luminance distribution generation unit 6, and the first panel data generation unit 7 are also all implemented by electronic circuitry dedicated to image processing in accordance with the present embodiment.

Alternatively, the backlight data generation unit 1, the backlight data correction unit 2, the backlight luminance distribution generation unit 3, and the second panel data generation unit 4 may be all implemented by a general-purpose semiconductor device called a CPU (central processing unit), in which case the functions of the backlight data generation unit 1, the backlight data correction unit 2, the backlight luminance distribution generation unit 3, and the second panel data generation unit 4 are achieved by the image processing programs installed in respective units. The backlight data generation unit 1, the backlight data correction unit 2, the backlight luminance distribution generation unit 3, the second panel data generation unit 4, the second panel data correction unit 5, the second panel luminance distribution generation unit 6, and the first panel data generation unit 7 in the present embodiment are structured by physically distinguishable components.

The input image data is fed to the image processing device 100 from the outside of the liquid crystal display device 1000. The input image data, that is, the input gray scales for each of the plurality of picture elements PE in the first liquid crystal panel CL, are fed inside the image processing device 100 to the first panel data generation unit 7, the second panel data generation unit 4, and the backlight data generation unit 1.

The backlight data generation unit 1 generates backlight data for controlling the outputs the plurality of light-emitting regions LER on the basis of the input image data. The backlight data matches a 6×4 resolution. The backlight data generation unit 1 generates, from the input image data, uncorrected output values for the plurality of light-emitting regions LER of the backlight BL (e.g., ON Ratio=Actual Luminance Value/Maximum Luminance Value). The backlight data generation unit 1, as an example, acquires a representative value of the input gray scales for those picture elements PE, that is, those subpixels, which are in a virtual region opposite one of the light-emitting regions LER. The representative value is, for example, a maximum, an average, a median, or 80% of the maximum of the input gray scales of the picture elements PE in a virtual region opposite one of the light-emitting regions LER. Thereafter, the backlight data generation unit 1 generates, as an output value of that one of the light-emitting regions LER, a value obtained by dividing the representative value of the input gray scales for those picture elements PE in one of the virtual regions by the upper limit value of the input gray scales. The upper limit value of the input gray scales is a maximum input gray scale.

The backlight data generation unit 1 contains a LUT (lookup table) defining the correspondence between the input grayscale data and the backlight data. Alternatively, the backlight data generation unit 1 may generate the backlight data by computation from the input image data, instead of using such a data table.

The backlight data generation unit 1 may generate smoothed (blurred) backlight data.

The backlight data correction unit 2 corrects the backlight data. For instance, the backlight data correction unit 2 increases the output value for each of the plurality of light-emitting regions LER specified by the backlight data. The backlight data correction unit 2 contains a LUT defining the correspondence between the uncorrected backlight data and the corrected backlight data. Alternatively, the backlight data correction unit 2 may calculate the corrected backlight data by computation from the uncorrected backlight data, instead of using such a data table. The backlight data correction unit 2 feeds the corrected backlight data to the backlight drive circuit 13. The corrected backlight data matches a 6×4 resolution.

The backlight luminance distribution generation unit 3 generates luminance distribution data for the backlight BL on the basis of the corrected backlight data. This backlight luminance distribution data is the luminance distribution data for the light, of the light emitted by the backlight BL, that reaches the locations of the plurality of pixels 2PX in the second liquid crystal panel WB.

The value of the backlight luminance distribution data may be determined taking into account a PSF (point spread function) from the light-emitting regions LER of the backlight BL to the pixels 2PX in the second liquid crystal panel WB. The backlight luminance distribution generation unit 3 contains a LUT defining the correspondence between the corrected backlight data and the luminance distribution data for the backlight BL. Alternatively, the backlight data correction unit 2 may generate the luminance distribution data for the second liquid crystal panel WB by computation from the corrected backlight data, instead of using such a data table.

The second panel data generation unit 4 generates the second panel data for controlling the aperture ratios of the plurality of pixels 2PX on the basis of the input image data. The second panel data matches a 240×135 resolution. The second panel data generation unit 4 generates an uncorrected aperture ratio for each of the plurality of pixels 2PX in a second liquid crystal panel CL from the input image data.

The second panel data generation unit 4, first of all, as an example, acquires a representative value of the input gray scales for those picture elements PE, that is, those subpixels, which are in a virtual region opposite one of the pixels 2PX. The representative value is, for example, a maximum, an average, a median, or 80% of the maximum of the input gray scales of the picture elements PE in a virtual region. Thereafter, the second panel data generation unit 4 generates, as an aperture ratio for that one of the pixels 2PX, a value obtained by dividing the representative value of the input gray scales for those picture elements PE in one of the virtual regions by the upper limit value of the input gray scales. The upper limit value of the input gray scales is a maximum input gray scale that may be specified by the input image data.

The second panel data generation unit 4 contains a LUT defining the correspondence between the input image data and the second panel data. The second panel data generation unit 4 may generate the second panel data by computation from the input image data, instead of using such a data table.

The second panel data generation unit 4 may generate a smoothed (perspective-angle filtered) aperture ratio as the aperture ratio for this one of the pixels 2PX.

The second panel data correction unit 5 corrects the second panel data. The corrected second panel data matches a 240×135 resolution. For instance, the second panel data correction unit 5 increases the aperture ratio for each of the plurality of pixels 2PX specified by the second panel data. The second panel data correction unit 5 contains a LUT defining the correspondence between the uncorrected second panel data and the corrected second panel data.

The second panel data correction unit 5 may correct the corrected second panel data by computation from the uncorrected second panel data, instead of using such a data table. The second panel data correction unit 5 feeds the corrected second panel data to the second panel drive circuit 12.

The second panel luminance distribution generation unit 6 generates luminance distribution data for the second liquid crystal panel WB on the basis of the corrected second panel data and the luminance distribution data for the backlight BL. Specifically, the second panel luminance distribution generation unit 6 calculates, for each of the plurality of pixels 2PX, the product of an aperture ratio for one pixel 2PX and a luminance for the backlight BL in the location of the one pixel 2PX. This procedure estimates luminance in the location of each of the plurality of pixels 2PX in the second liquid crystal panel WB.

The value of the second liquid crystal panel luminance distribution data may be determined taking into account a PSF (point spread function) from the pixels 2PX in the second liquid crystal panel WB to the picture elements PE in the first liquid crystal panel CL. The second panel luminance distribution data is the luminance distribution data for the light, of the light emitted by the backlight BL, that reaches the locations of the plurality of picture elements PE in the first liquid crystal panel CL.

The second panel luminance distribution generation unit 6 contains a LUT defining the correspondence between the corrected second panel data and the luminance distribution data for the second liquid crystal panel WB. The second panel luminance distribution generation unit 6 may generate the luminance distribution data for the second liquid crystal panel CL by computation from the corrected second panel data, instead of using such a data table.

The first panel data generation unit 7 generates the first panel data for controlling the aperture ratios of the plurality of picture elements PE on the basis of the input image data and the luminance distribution data for the second liquid crystal panel WB. The first panel data generation unit 7 contains a LUT defining the correspondence between the input image data, the luminance distribution data for the second liquid crystal panel WB, and the first panel data.

The first panel data generation unit 7 may generate the first panel data by computation from the input image data and the luminance distribution data for the second liquid crystal panel WB, instead of using such a data table. The first panel data generation unit 7 feeds the first panel data to the first panel drive circuit 11.

The image processing device 100 is capable of generating separate control data for each of the backlight BL and the second liquid crystal panel WB for the following reasons. (1) Two separate data paths are provided to generate the corrected backlight data and the corrected second panel data. More particularly, the corrected backlight data is generated by the backlight data generation unit 1 and the backlight data correction unit 2 processing the input image data. The corrected second panel data is generated by the second panel data generation unit 4 and the second panel data correction unit 5 processing the input image data. The backlight data and the second panel data are not at all related in these two data paths. In other words, the backlight data and the second panel data are processed independently from each other. The processing of any of the backlight data and the second panel data therefore does not affect the processing of the other of the backlight data and the second panel data. (2) Additionally, particularly, the backlight data correction unit 2 and the second panel data correction unit 5 correct the corrected backlight data and the corrected second panel data respectively and independently from each other. The backlight data generation unit 1 and the backlight data correction unit 2 can therefore change the properties of the corrected backlight data and the properties of the corrected second panel data respectively, independently from each other, and freely.

This mechanism provides an increased degree of freedom in selecting a combination of the two types of control data (i.e., the second panel data and the backlight data). The liquid crystal display device 1000 can hence provide increased variations in display characteristics.

However, the picture elements PE in the first liquid crystal panel CL could produce an insufficient luminance because if the control data for the backlight BL and the control data for the second liquid crystal panel WB are independently generated, the output values for the backlight BL and the aperture ratios for the second liquid crystal panel WB can be independently and arbitrarily selected. When the picture elements PE in the first liquid crystal panel CL produce an insufficient luminance, the input image specified by the input image data cannot be displayed.

Accordingly, in the liquid crystal display device 1000, the backlight data correction unit 2 and the second panel data correction unit 5 correct the backlight data and the second panel data respectively in such a manner as to meet correction conditions that for each one of the plurality of picture elements PE, the luminance that can be specified for the location corresponding to one picture element PE that can be specified by the luminance distribution data for the second liquid crystal panel WB is greater than or equal to the luminance that can be specified for the one picture element PE by the input image data.

Specifically, the backlight data correction unit 2 and the second panel data correction unit 5 correct the backlight data and the second panel data respectively so as to meet the conditions represented by $Bx \times Mx \geq Ix$, where $0 \leq Bx \leq 1$, $0 \leq Mx \leq 1$, and $0 \leq Ix \leq 1$.

Bx is the ratio of the actual luminance of the backlight BL to the maximum luminance of the backlight BL in a location corresponding to each of the plurality of picture elements PE. Mx is the aperture ratio of the pixel 2PX in the second liquid crystal panel WB in a location corresponding to each of the plurality of picture elements PE. Ix is the ratio of the input gray scale actually fed to the corresponding one of the plurality of picture elements PE to the maximum input gray scale that can be fed to each of the plurality of picture elements PE, that is, the ratio of the actual luminance of the corresponding picture element PE to the maximum luminance of the corresponding picture element PE.

The image processing device 100 in accordance with the present embodiment performing such control can prevent an inconvenient situation where the picture element PE fails to achieve a luminance corresponding to the input gray scale even if the picture element PE has an aperture ratio of 100%.

In the present embodiment, the backlight data correction unit 2 and the second panel data correction unit 5 correct the backlight data and the second panel data respectively in the following manner. For each of the plurality of light-emitting regions LER of the backlight BL, the output of one light-emitting region LER that can be specified by the corrected backlight data is greater than or equal to the output of one light-emitting region LER that can be specified by the uncorrected backlight data. In addition, for each of the plurality of pixels 2PX in the second liquid crystal panel WB, the aperture ratio of one pixel 2PX that can be specified by the corrected second panel data is greater than or equal to the aperture ratio of one pixel 2PX that can be specified by the uncorrected second panel data. Owing to these, the backlight data correction unit 2 and the second panel data correction unit 5 can easily meet the correction conditions for the backlight data and the second panel data respectively.

In other words, the backlight data correction unit 2 increases the corrected output more than the uncorrected output for the plurality of light-emitting regions LER of the backlight BL. In addition, the second panel data correction unit 5 increases the corrected aperture ratio more than the uncorrected aperture ratio for the plurality of pixels 2PX in the second liquid crystal panel WB.

Meanwhile, the first panel data generation unit 7 determines an aperture ratio for the plurality of picture elements PE on the basis of the luminance distribution data for the second liquid crystal panel CL and the aperture ratios of the plurality of picture elements PE in such a manner that the display panel unit 10 can display an input image specified by the input image data. Therefore, the luminances of a plurality of rays of light passing through the plurality of picture elements PE generally match the respective luminances in a plurality of locations in the input image corresponding respectively to the plurality of picture elements PE specified by the input image data. The display panel unit 10 can hence easily display an input image specified by the input image data.

FIG. 2 is a cross-sectional view of the display panel unit 10 in the liquid crystal display device 1000 common to all embodiments. Referring to FIG. 2, the first liquid crystal panel CL, the second liquid crystal panel WB, and the backlight BL are arranged in this order in the display panel unit 10. The first liquid crystal panel CL and the second liquid crystal panel WB are disposed so as to face each other. The second liquid crystal panel WB and the backlight BL are also disposed so as to face each other.

Figure 3:
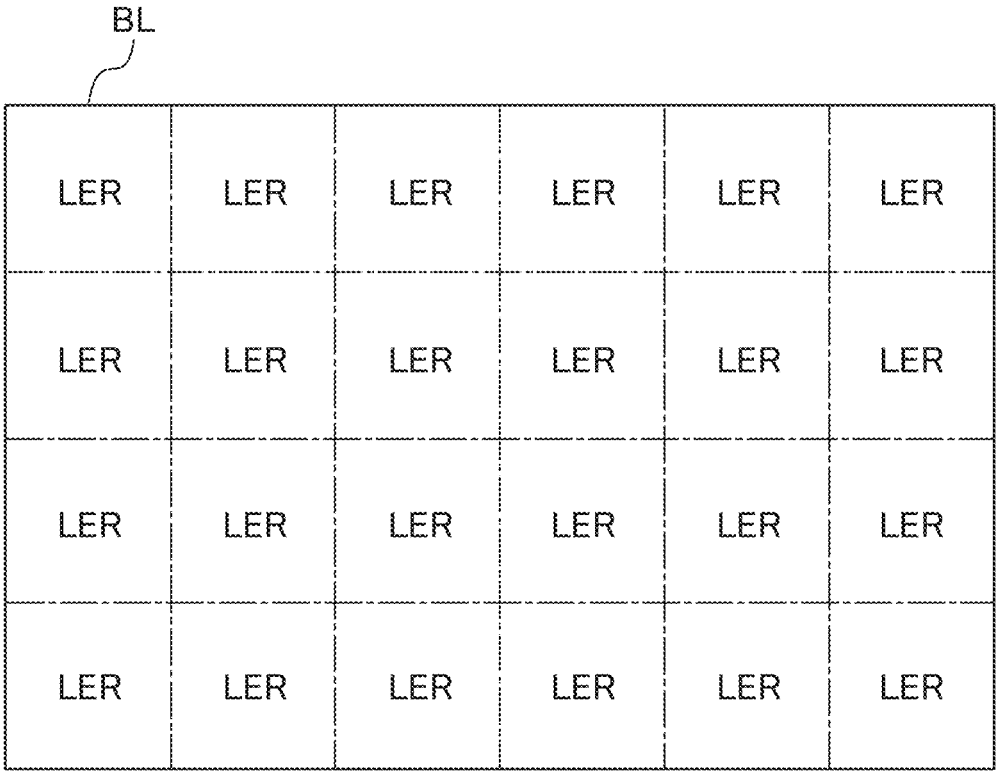
FIG. 3 is a plan view of a plurality of light-emitting regions of a backlight in the liquid crystal display device that is common to all embodiments.

FIG. 3 is a plan view of the plurality of light-emitting regions LER of the backlight BL in the liquid crystal display device 1000 common to all embodiments. Referring to FIG. 3, the backlight BL is divided into a plurality of light-emitting regions LER, specifically, 6×4=24 light-emitting regions LER. The image processing device 100 controls the output separately for each of the plurality of light-emitting regions LER. The plurality of LEDs in each of the plurality of light-emitting regions LER are controlled in the same luminescent mode.

Figure 4:
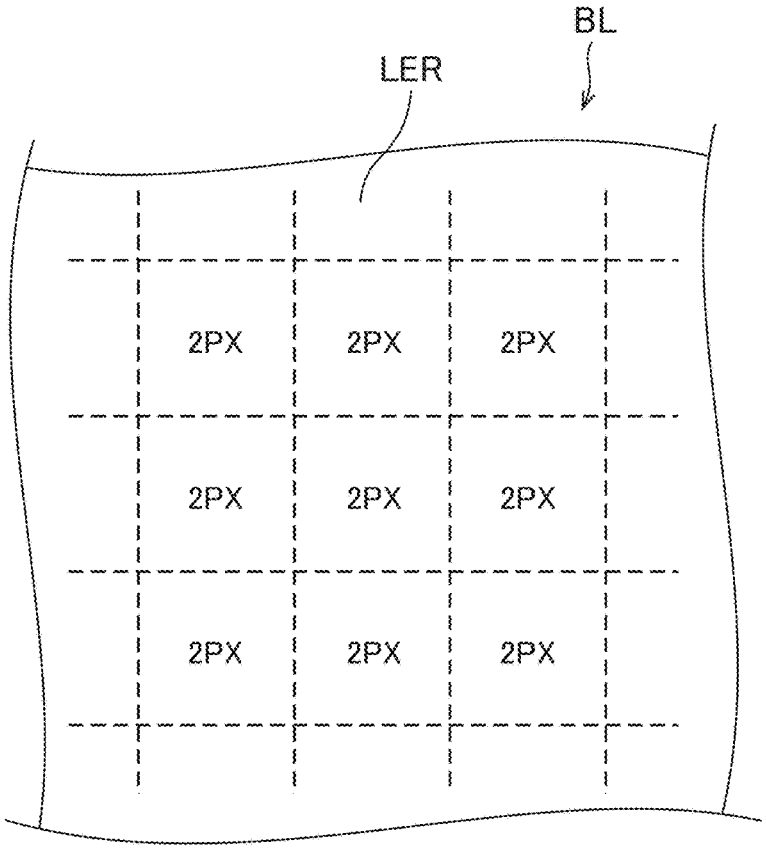
FIG. 4 is an illustration of a relationship between the light-emitting regions of the backlight and pixels in a second (monochrome) liquid crystal panel in the liquid crystal display device that is common to all embodiments.

FIG. 4 is an illustration of a relationship between the light-emitting regions LER of the backlight BL and the pixels 2PX in the second (monochrome) liquid crystal panel WB in the liquid crystal display device 1000 common to all embodiments. FIG. 4 demonstrates that each single virtual region opposite one of the plurality of light-emitting regions LER contains some of the pixels 2PX.

Figure 5:
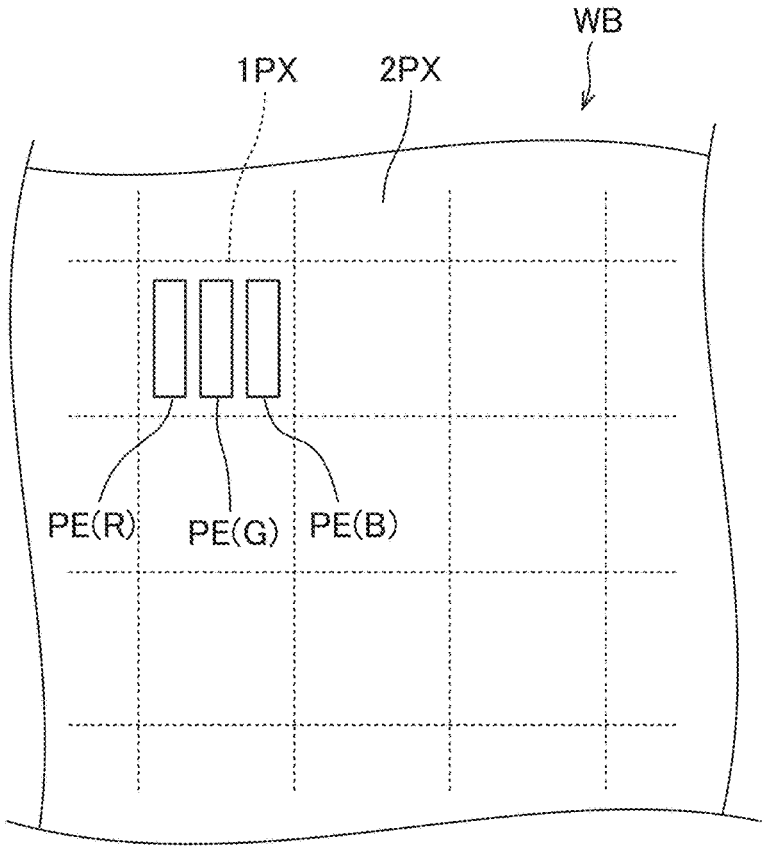
FIG. 5 is an illustration of a relationship between the pixels in the second (monochrome) liquid crystal panel and picture elements in a first (color) liquid crystal panel in the liquid crystal display device that is common to all embodiments.

FIG. 5 is an illustration of a relationship between the pixels 2PX in the second (monochrome) liquid crystal panel WB and the pixels 1PX and the picture elements PE in the first (color) liquid crystal panel CL in the liquid crystal display device 1000 common to all embodiments. FIG. 5 demonstrates that each single virtual region opposite one of the plurality of pixels 2PX contains some of the pixels 1PX and that each of these pixels 1PX contains three picture elements PE. In other words, each single virtual region opposite one of the plurality of pixels 2PX contains some of the picture elements PE.

A comparison of FIGS. 3 to 5 demonstrates that the plurality of picture elements PE in the first liquid crystal panel CL, the plurality of pixels 2PX in the second liquid crystal panel WB, and the plurality of light-emitting regions LER of the backlight BL have respective resolutions that decrease in this order.

Each pixel 2PX in the second liquid crystal panel WB is controlled by the image processing device 100 so as to, for example, achieve a maximum luminance for the input gray scale for those picture elements PE which are in a single virtual region opposite the pixel 2PX that can be specified by the input image data.

Each light-emitting region LER of the backlight BL is controlled by the image processing device 100 so as to, for example, achieve a maximum luminance for the input gray scale for those picture elements PE which are in a single virtual region opposite the light-emitting region LER that can be specified by the input image data.

Figure 6:
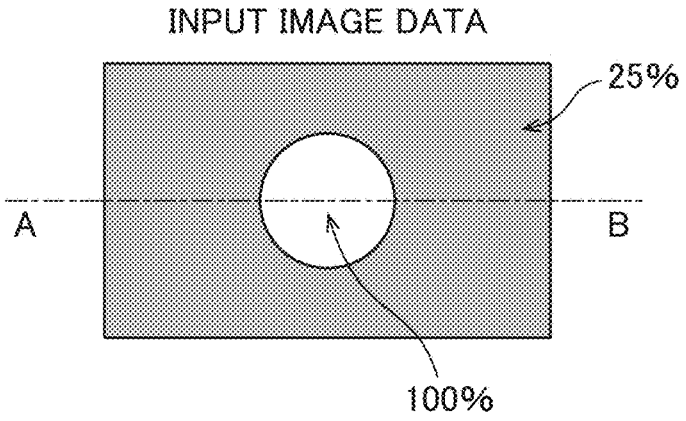
FIG. 6 is a diagram of an exemplary input image specified by input image data that is common to all embodiments.

FIG. 6 is a diagram of an exemplary input image specified by the input image data common to all embodiments.

Referring to FIG. 6, the display panel unit 10 is displaying an image including a circular bright portion where luminance is 100% of the maximum luminance and a rectangular dark portion, located around the circular bright portion, where luminance is 25% of the maximum luminance.

Figure 7:
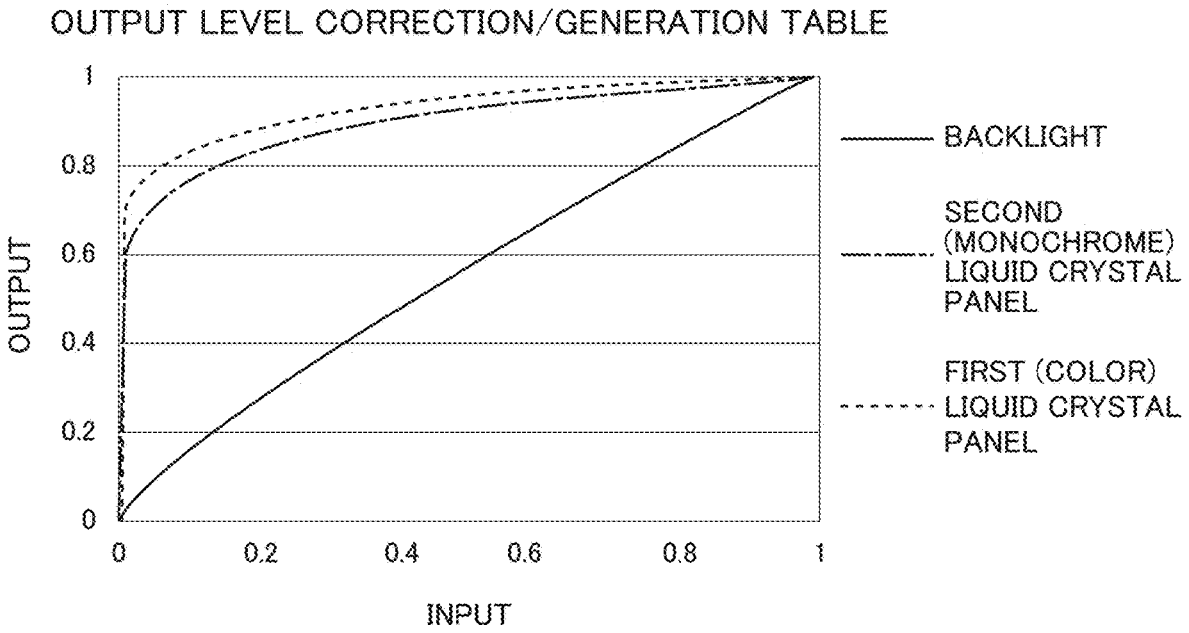
FIG. 7 is a graph representing an output level correction/generation table defining an input/output relationship for each of a backlight data correction unit, a second panel data correction unit, and a first panel data generation unit in a liquid crystal display device in accordance with Embodiment 1.

FIG. 7 is a graph representing an output level correction/generation table defining an input/output relationship for each of the backlight data correction unit 2, the second panel data correction unit 5, and the first panel data generation unit 7 in the liquid crystal display device 1000 in accordance with Embodiment 1. The lines for the second panel data and the backlight data in the graph represent output level correction/generation tables for use by the backlight data correction unit 2 and the second panel data correction unit 5 respectively. The line for the first panel data in the graph represents results generated by the first panel data generation unit 7.

FIG. 7 demonstrates that the backlight data correction unit 2 generates the corrected backlight data from the uncorrected backlight data so that the input and the output have a relationship approximated by a proportional relation throughout the entire range of 0 to 1. The second panel data correction unit 5 generates the corrected second panel data from the uncorrected second panel data so that the output is greater than the input throughout the entire range of 0 to 1. The first panel data generation unit 7 thus generates the first panel data from the input image data so that the output is greater than the input throughout the entire range of 0 to 1.

Figure 8:
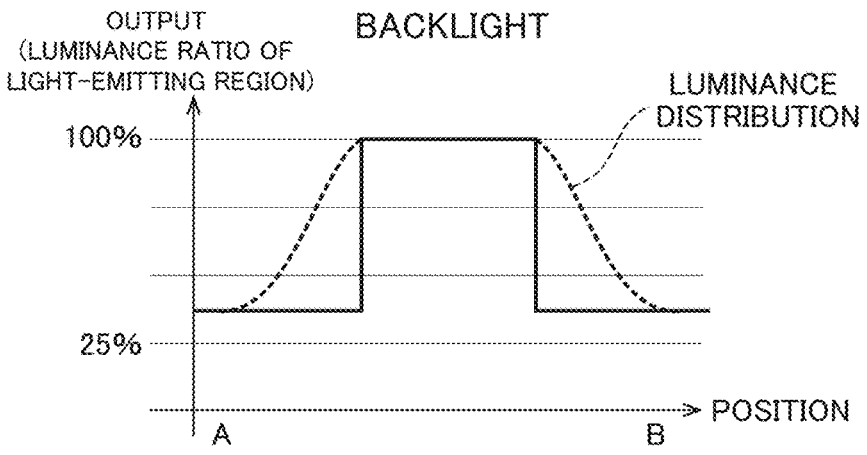
FIG. 8 is a graph representing a relationship between a position on line A-B in FIG. 6 in the backlight in the liquid crystal display device in accordance with Embodiment 1 and an output (ON ratio) of the backlight.

FIG. 8 is a graph representing a relationship between a position on line A-B in FIG. 6 in the backlight BL in the liquid crystal display device 1000 in accordance with Embodiment 1 and an output of the backlight BL. The dotted line in FIG. 8 represents the luminance distribution data generated by using a PSF for the location of the light emitted by the backlight BL in the second liquid crystal panel WB.

Figure 9:
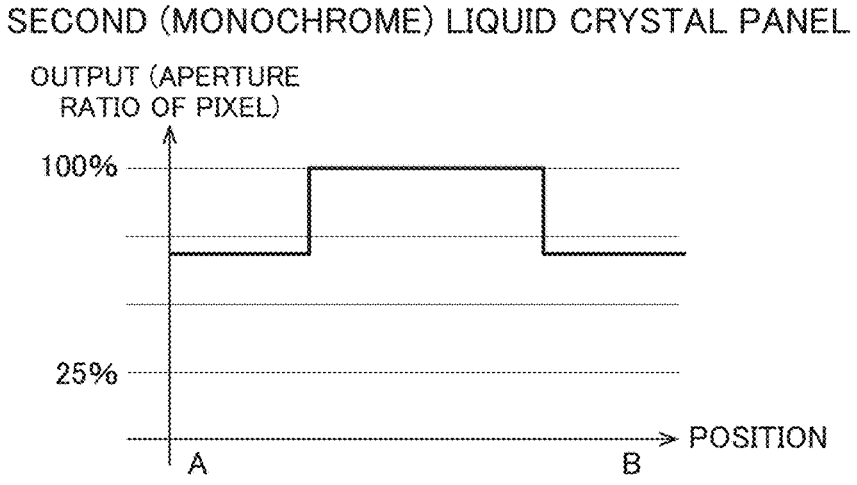
FIG. 9 is a graph representing a relationship between a position on line A-B in FIG. 6 in a second (monochrome) liquid crystal panel in the liquid crystal display device in accordance with Embodiment 1 and an output (aperture ratio of a pixel) of the second liquid crystal panel.

FIG. 9 is a graph representing a relationship between a position on line A-B in FIG. 6 in the second liquid crystal panel WB in the liquid crystal display device 1000 in accordance with Embodiment 1 and the output (aperture ratio of the pixel 2PX) of the second liquid crystal panel WB. The graph of FIG. 9 is not a graph representing the relationship generated by using a PSF for the backlight BL, but may be a graph representing the relationship generated by using a PSF for the backlight BL.

Figure 10:
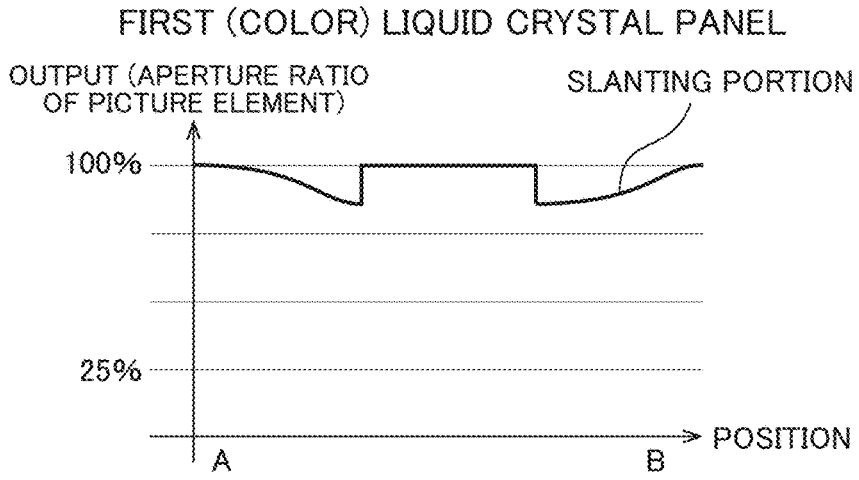
FIG. 10 is a graph representing a relationship between a position on line A-B in FIG. 6 in a first (color) liquid crystal panel in the liquid crystal display device in accordance with Embodiment 1 and an output (aperture ratio of a picture element) of the first liquid crystal panel.

FIG. 10 is a graph representing a relationship between a position on line A-B in FIG. 6 in the first liquid crystal panel CL in the liquid crystal display device 1000 in accordance with Embodiment 1 and the output (aperture ratio of the picture element PE) of the first liquid crystal panel CL. The slanting line portions in the graph of FIG. 10 represent the aperture ratio generated by using a PSF for the picture element PE, taking into account the luminance distribution data for the location of the light emitted by the backlight BL in the second liquid crystal panel WB, so as to display an input image specified by the input image data.

For each of the plurality of pixels 2PX, the aperture ratio of one pixel that can be specified by the corrected second panel data is greater than the luminance ratio in the location of one pixel that can be specified by the luminance distribution data for the backlight. In such a case, the luminance ratio is the ratio of the actual luminance of the backlight BL to a maximum output luminance of the backlight BL in the location of one pixel 2PX. Specifically, $Bx<Mx$, where $0 \leq Bx \leq 1$ and $0 \leq Mx \leq 1$. Bx is the ratio of the actual luminance of the backlight BL to a maximum luminance of the backlight BL in the location of each of the plurality of pixels 2PX. Mx is the aperture ratio of each of the plurality of pixels 2PX. Referring to FIG. 7, the line for the backlight data (corresponding to Bx) is positioned below the line for the second panel data (corresponding to Mx) throughout the entire input range in the graph. Therefore, $Bx<Mx$.

The correction by the backlight data correction unit 2 and the second panel data correction unit 5 enables maintaining the gray scales of the second liquid crystal panel WB at relatively high values while restraining the output (ON Ratio=Actual Luminance/Maximum Luminance Value) of the backlight BL at relatively low values. Accordingly, the power consumption of the liquid crystal display device 1000 can be reduced without having to lose the advantage of improved contrast between the picture elements PE when the three layers of the first liquid crystal panel CL, the second liquid crystal panel WB, and the backlight BL are used.

Embodiment 2

The following will describe a liquid crystal display device 1000 in accordance with Embodiment 2 with reference to FIGS. 11 to 14. Similar description to Embodiment 1 is not repeated below. The liquid crystal display device 1000 in accordance with the present embodiment differs from the liquid crystal display device 1000 in accordance with Embodiment 1 in the output level correction/generation table. The liquid crystal display device 1000 in accordance with the present embodiment is otherwise the same as the liquid crystal display device 1000 in accordance with Embodiment 1.

Figure 11:
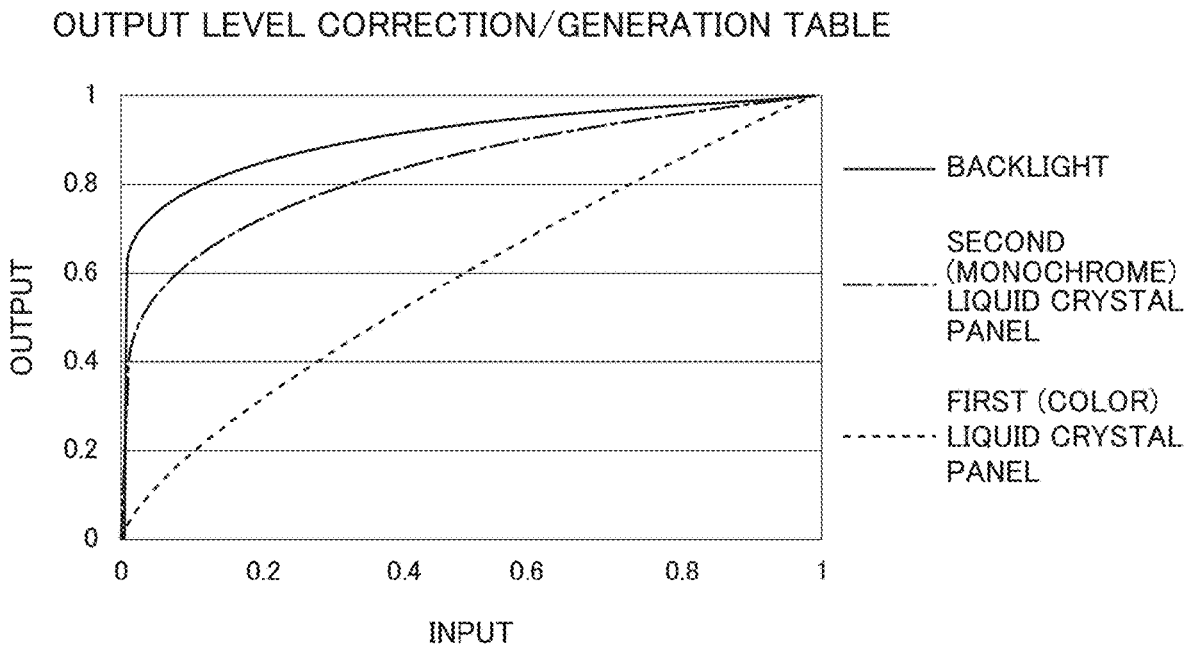
FIG. 11 is a graph representing an output level correction/generation table defining an input/output relationship for each of a backlight data correction unit, a second panel data correction unit, and a first panel data generation unit in a liquid crystal display device in accordance with Embodiment 2.

FIG. 11 is a graph representing an output level correction/generation table defining an input/output relationship for each of the backlight data correction unit 2, the second panel data correction unit 5, and the first panel data generation unit 7 in the liquid crystal display device 1000 in accordance with Embodiment 2. Similarly to the foregoing, the lines for the second panel data and the backlight data in the graph represent output level correction/generation tables for use by the backlight data correction unit 2 and the second panel data correction unit 5 respectively. The line for the first panel data in the graph represents results generated by the first panel data generation unit 7.

FIG. 11 demonstrates that the second panel data correction unit 5 generates the corrected second panel data from the uncorrected second panel data so that the output is greater than the input throughout the entire range of 0 to 1. The backlight data correction unit 2 generates the corrected backlight data from the uncorrected backlight data so that the output is greater than the input throughout the entire range of 0 to 1. The first panel data generation unit 7 thus generates the first panel data from the input image data so that the input and the output have a relationship approximated by a proportional relation throughout the entire range of 0 to 1.

Figure 12:
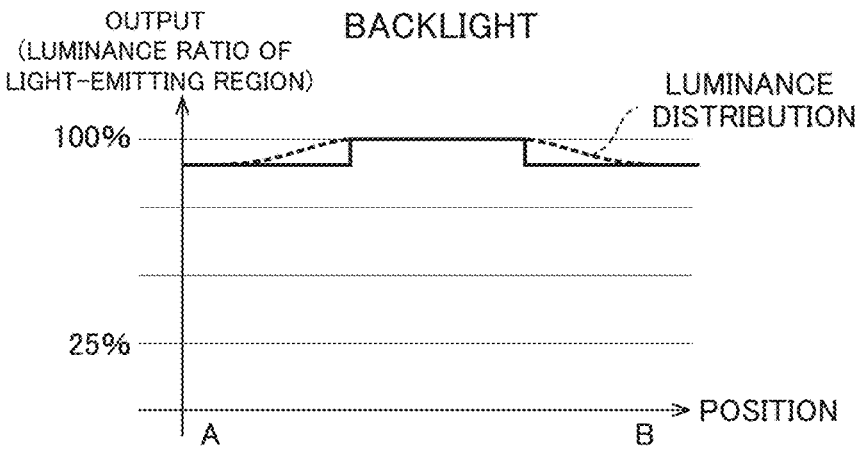
FIG. 12 is a graph representing a relationship between a position on line A-B in FIG. 6 in the backlight in the liquid crystal display device in accordance with Embodiment 2 and an output (ON ratio) of the backlight.

FIG. 12 is a graph representing a relationship between a position on line A-B in FIG. 6 in the backlight BL in the liquid crystal display device 1000 in accordance with Embodiment 2 and an output of the backlight BL. The dotted line in FIG. 12 represents the luminance distribution data generated by using a PSF for the location of the light emitted by the backlight BL in the second liquid crystal panel WB.

Figure 13:
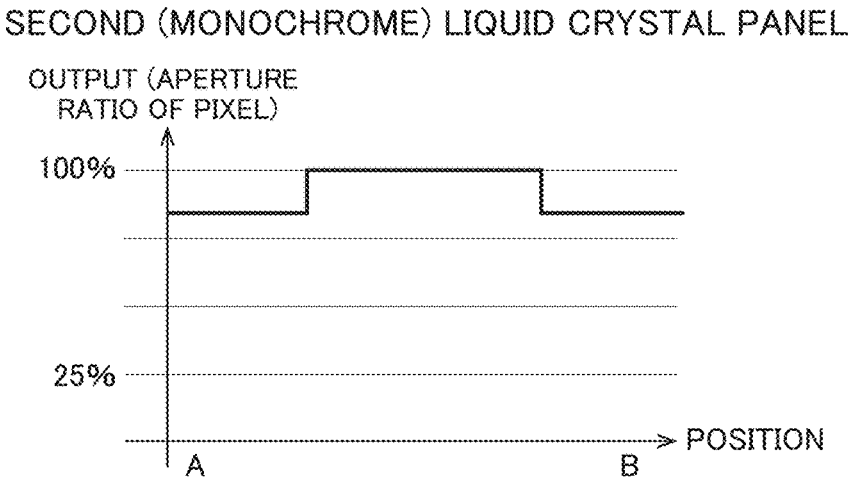
FIG. 13 is a graph representing a relationship between a position on line A-B in FIG. 6 in a second (monochrome) liquid crystal panel in the liquid crystal display device in accordance with Embodiment 2 and an output (aperture ratio of a pixel) of the second liquid crystal panel.

FIG. 13 is a graph representing a relationship between a position on line A-B in FIG. 6 in the second liquid crystal panel WB in the liquid crystal display device 1000 in accordance with Embodiment 2 and an output (aperture ratio of the pixel 2PX) of the second liquid crystal panel WB. The graph of FIG. 13 is not a graph representing the relationship generated by using a PSF for the backlight BL, but may be a graph representing the relationship generated by using a PSF for the backlight BL.

Figure 14:
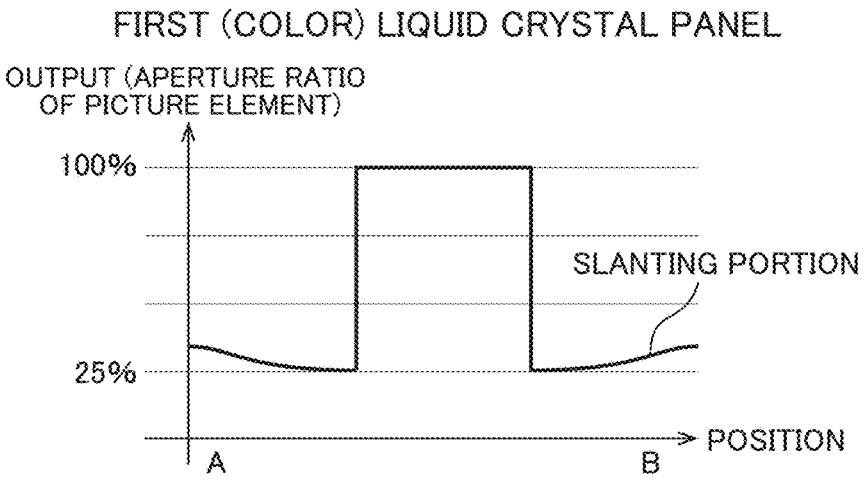
FIG. 14 is a graph representing a relationship between a position on line A-B in FIG. 6 in a first (color) liquid crystal panel in the liquid crystal display device in accordance with Embodiment 2 and an output (aperture ratio of a picture element) of the first liquid crystal panel.

FIG. 14 is a graph representing a relationship between a position on line A-B in FIG. 6 of first liquid crystal panel CL in the liquid crystal display device 1000 in accordance with Embodiment 2 and the output (aperture ratio of the picture element PE) of the first liquid crystal panel WB. The slanting line portions in the graph of FIG. 14 represent the aperture ratio generated by using a PSF for the picture element PE, taking into account the luminance distribution data for the location of the light emitted by the backlight BL in the second liquid crystal panel WB, so as to display an input image specified by the input image data.

For each of the plurality of pixels 2PX, the aperture ratio of one pixel that can be specified by the corrected second panel data is smaller than the luminance ratio in the location of one pixel 2PX that can be specified by the luminance distribution data for the backlight BL. In such a case, the luminance ratio is the ratio of the actual luminance of the backlight BL to a maximum output luminance of the backlight BL in the location of one pixel 2PX. Specifically, $Bx>Mx$, where $0 \leq Bx \leq 1$ and $0 \leq Mx \leq 1$. Bx is the ratio of the actual luminance of the backlight BL to a maximum luminance of the backlight BL in the locations of the plurality of pixels 2PX. Mx is the aperture ratio each of the plurality of pixels 2PX. Referring to FIG. 11, the line for the backlight data (corresponding to Bx) is positioned above the line for the second panel data (corresponding to Mx) throughout the entire input range in the graph. Therefore, Bx>Mx.

This configuration can maintain the output (ON ratio) of the backlight BL at relatively high values. The output of the backlight BL and the aperture ratio of the second liquid crystal panel WB (monochrome liquid crystal panel) are only significantly changed when the input gray scale is extremely small. Accordingly, the configuration can reduce to a minimum the adverse effects of halo effect that occurs at a boundary where the output of the backlight BL significantly changes.

Embodiment 3

The following will describe a liquid crystal display device 1000 in accordance with Embodiment 3 with reference to FIGS. 15 to 18. Similar description to Embodiment 1 is not repeated below. The liquid crystal display device 1000 in accordance with the present embodiment differs from the liquid crystal display device 1000 in accordance with Embodiment 1 in the output level correction/generation table. The liquid crystal display device 1000 in accordance with the present embodiment is otherwise the same as the liquid crystal display device 1000 in accordance with Embodiment 1.

Figure 15:
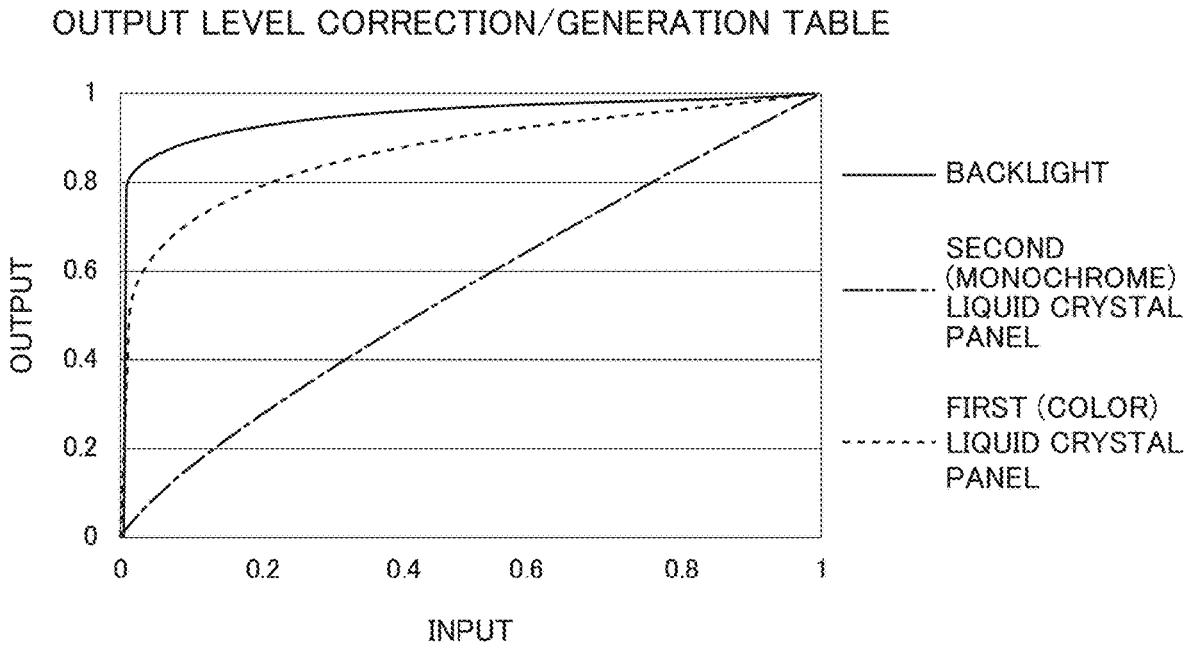
FIG. 15 is a graph representing an output level correction/generation table defining an input/output relationship for each of a backlight data correction unit, a second panel data correction unit, and a first panel data generation unit in a liquid crystal display device in accordance with Embodiment 3.

FIG. 15 is a graph representing an output level correction/generation table defining an input/output relationship for each of the backlight data correction unit 2, the second panel data correction unit 5, and the first panel data generation unit 7 in the liquid crystal display device 1000 in accordance with Embodiment 3. Similarly to the foregoing, the lines for the second panel data and the backlight data in the graph represent output level correction/generation tables for use by the backlight data correction unit 2 and the second panel data correction unit 5 respectively. The line for the first panel data in the graph represents results generated by the first panel data generation unit 7.

FIG. 15 demonstrates that the second panel data correction unit 5 generates the corrected second panel data from the uncorrected second panel data so that the input and the output have a relationship approximated by a proportional relation throughout the entire range of 0 to 1. The backlight data correction unit 2 generates the corrected backlight data from the uncorrected backlight data so that the output is greater than the input throughout the entire range of 0 to 1. The first panel data generation unit 7 thus generates the first panel data from the input image data so that the output is greater than the input throughout the entire range of 0 to 1.

Figure 16:
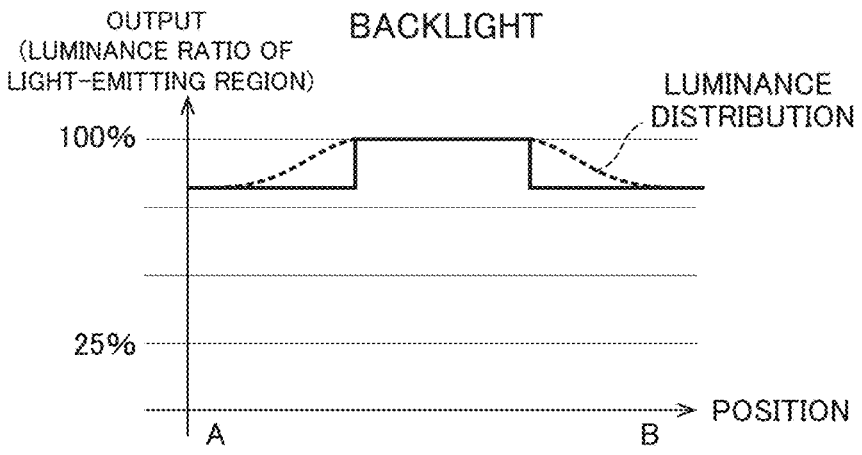
FIG. 16 is a graph representing a relationship between a position on line A-B in FIG. 6 in the backlight in the liquid crystal display device in accordance with Embodiment 3 and an output (ON ratio) of the backlight.

FIG. 16 is a graph representing a relationship between a position on line A-B in FIG. 6 in the backlight BL in the liquid crystal display device 1000 in accordance with Embodiment 3 and an output of the backlight BL. The dotted line in FIG. 16 represents the luminance distribution data generated by using a PSF for the location of the light emitted by the backlight BL in the second liquid crystal panel WB.

Figure 17:
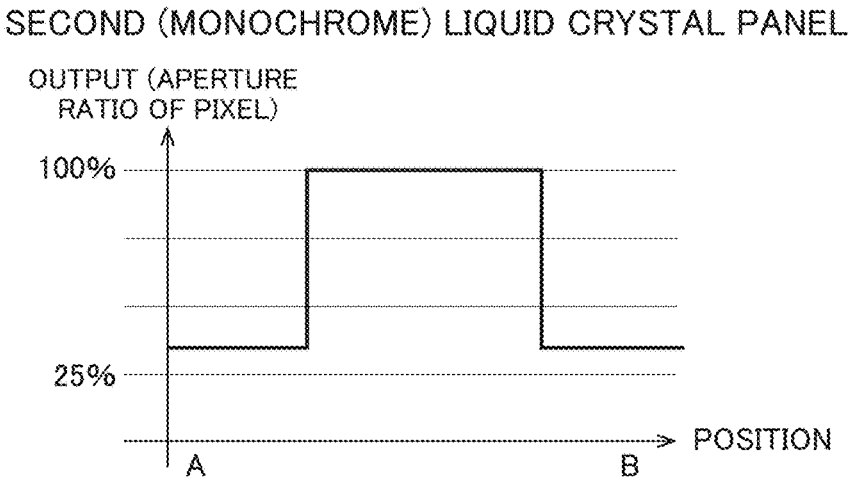
FIG. 17 is a graph representing a relationship between a position on line A-B in FIG. 6 in a second (monochrome) liquid crystal panel in the liquid crystal display device in accordance with Embodiment 3 and an output (aperture ratio of a pixel) of the second liquid crystal panel.

FIG. 17 is a graph representing a relationship between a position on line A-B in FIG. 6 in the second liquid crystal panel WB in the liquid crystal display device 1000 in accordance with Embodiment 3 and an output (aperture ratio of the pixel 2PX) of the second liquid crystal panel WB. The graph of FIG. 17 is not a graph representing the relationship generated by using a PSF for the backlight BL, but may be a graph representing the relationship generated by using a PSF for the backlight BL.

Figure 18:
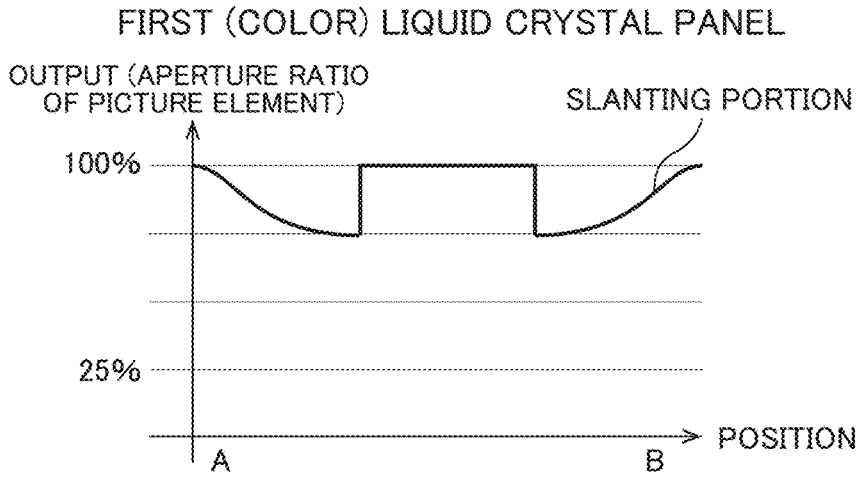
FIG. 18 is a graph representing a relationship between a position on line A-B in FIG. 6 in a first (color) liquid crystal panel in the liquid crystal display device in accordance with Embodiment 3 and an output (aperture ratio of a picture element) of the first liquid crystal panel.

FIG. 18 is a graph representing a relationship between a position on line A-B in FIG. 6 in the first (color) liquid crystal panel (first liquid crystal panel CL) in the liquid crystal display device in accordance with Embodiment 3 and the output (aperture ratio of the picture element PE) of the first liquid crystal panel CL. The slanting line portions in the graph of FIG. 18 represent the aperture ratio generated by using a PSF for the picture element PE, taking into account the luminance distribution data for the location of the light emitted by the backlight BL in the second liquid crystal panel WB, so as to display an input image specified by the input image data.

For each of the plurality of picture elements PE, the aperture ratio of one picture element that can be specified by the first panel data is greater than or equal to the aperture ratio of one pixel 2PX in a location corresponding to one picture element PE. Specifically, Bx>Mx, and Mx≤Cx, where 0≤Bx≤1, 0≤Mx≤1, and 0≤Cx≤1. Bx is the ratio of the actual luminance of the backlight BL to the maximum luminance of the backlight BL in the locations corresponding to the plurality of picture elements PE. Mx is the aperture ratio of the pixel 2PX in the location corresponding to the location of each of the plurality of picture elements PE. Cx is the aperture ratio of each of the plurality of picture elements PE. Referring to FIG. 15, the line for the backlight data (corresponding to Bx) is positioned above the line for the second panel data (corresponding to Mx) throughout the entire input range in the graph. Therefore, Bx>Mx. In addition, the line for the second panel data (corresponding to Mx) is positioned below the line for the first panel data (corresponding to Cx) throughout the entire input range in the graph. Therefore, Mx≤Cx.

The liquid crystal display device 1000 in accordance with Embodiment 3 preferentially determines gray scales for the second liquid crystal panel WB (monochrome liquid crystal panel), and only when the input grayscale data specified by the input image data is small, significantly changes aperture ratios for the first liquid crystal panel CL (color liquid crystal panel). This configuration can make the most use of the capability of the first liquid crystal panel CL to fine-tune gray scales. The configuration thus enhances the gray scale properties, particularly, in dark portions of the image. To describe in further detail, the gray scale control in the liquid crystal display device 1000 in accordance with Embodiment 3 comes from the concept that the gray scales are roughly adjusted by the second liquid crystal panel WB and finely adjusted by the first liquid crystal panel CL. For instance, when some input gray scales are small in the input image data, and the luminance values for the plurality of pixels 2PX in the second liquid crystal panel WB are somewhat close to the targeted low luminance values, the luminance of the picture element PE can be fine-tuned as a final step by using all the 255 gray scales (for 8-bit data) for the first liquid crystal panel CL. The liquid crystal display device 1000 in accordance with Embodiment 3 can hence display an image with smoother luminance changes.

Embodiment 4

The liquid crystal display device 1000 in accordance with the present embodiment differs from the liquid crystal display device 1000 in accordance with Embodiment 1 in that in the former, all the units in the image processing device 100 are provided by control processes performed by image processing programs. The liquid crystal display device 1000 in accordance with the present embodiment is otherwise the same as the liquid crystal display device 1000 in accordance with Embodiment 1.

More specifically, the backlight data generation unit 1, the backlight data correction unit 2, the backlight luminance distribution generation unit 3, and the second panel data generation unit 4 are provided by control processes performed by image processing programs. In addition, the second panel data correction unit 5, the second panel luminance distribution generation unit 6, and the first panel data generation unit 7 are also provided by control processes performed by image processing programs.

In other words, the computer serving as the image processing device 100 includes, as a main hardware element, a processor that operates under image processing programs, for example, a CPU (central processing unit). The processor may be of any type so long as the processor is capable of implementing functions by executing image processing programs. The processor includes one or more electronic circuits including a semiconductor integrated circuit, for example, an IC (integration circuit) or an LSI (large scale integration) circuit. The electronic circuits may be integrated into a single chip and may be provided in a plurality of chips. The plurality of chips may be combined into a single device and may be provided in a plurality of devices.

The image processing programs are contained in a non-transitory storage medium such as a computer-readable ROM (read-only memory), an optical disc, or a hard disk drive. A content provision program may be stored in a storage medium in advance and may be delivered to a storage medium over a wide-area communication network such as the Internet.

What is claimed is:

1. An image processing device that has a display panel unit to display an image, the display panel unit including: a first liquid crystal panel including a plurality of picture elements; a second liquid crystal panel opposite the first liquid crystal panel and including a plurality of pixels; and a backlight opposite the second liquid crystal panel and having a plurality of light-emitting regions, the image processing device comprising:

a backlight data generation circuit configured to generate backlight data from input image data to control outputs of the plurality of light-emitting regions;

a backlight data correction circuit configured to increase an output value for each of the plurality of light-emitting regions specified by the backlight data;

a backlight luminance distribution generation circuit configured to generate luminance distribution data for the backlight from the output value for each of the plurality of light-emitting regions that has been increased by the backlight data correction circuit;

a second panel data generation circuit configured to generate second panel data from the input image data to control aperture ratios of the plurality of pixels;

a second panel data correction circuit configured to increase an aperture ratio for each of the plurality of pixels specified by the second panel data;

a second panel luminance distribution generation circuit configured to generate luminance distribution data for the second liquid crystal panel from the luminance distribution data for the backlight and the aperture ratio for each of the plurality of pixels that has been increased by the second data correction circuit; and a first panel data generation circuit configured to generate first panel data from the input image data and the luminance distribution data for the second liquid crystal panel to control aperture ratios of the plurality of picture elements.

2. The image processing device according to claim 1, wherein the first panel data generation circuit determines the aperture ratios of the plurality of picture elements from the luminance distribution data for the second liquid crystal panel and the aperture ratios of the plurality of picture elements so that the display panel circuit can display an input image specified by the input image data.

3. The image processing device according to claim 1, wherein as for each of the plurality of light-emitting regions, an output of one light-emitting region that can be specified by the backlight data that is corrected is greater than or equal to an output of the one region that can be specified by the backlight data that is uncorrected, and as for each of the plurality of pixels, an aperture ratio of one pixel that can be specified by the second panel data that is corrected is greater than or equal to an aperture ratio of one pixel that can be specified by the second panel data that is uncorrected.

4. The image processing device according to claim 1, wherein as for each of the plurality of picture elements, a luminance in a location of one picture element that can be specified by the luminance distribution data for the second liquid crystal panel is greater than or equal to a luminance of the one picture element that can be specified by the input image data.

5. The image processing device according to claim 4, wherein as for each of the plurality of pixels, an aperture ratio of one pixel that can be specified by the second panel data that is corrected is greater than a luminance ratio in a location of the one pixel that can be specified by the luminance distribution data for the backlight, and the luminance ratio is a ratio of an actual luminance of the backlight to a maximum output luminance of the backlight in the location of the one pixel.

6. The image processing device according to claim 4, wherein as for each of the plurality of pixels, an aperture ratio of one pixel that can be specified by the second panel data that is corrected is smaller than a luminance ratio in a location of the one pixel that can be specified by the luminance distribution data for the backlight, and the luminance ratio is a ratio of an actual luminance of the backlight to a maximum output luminance of the backlight in the location of the one pixel.

7. The image processing device according to claim 6, wherein as for each of the plurality of picture elements, an aperture ratio of one picture element that can be specified by the first panel data is greater than or equal to an aperture ratio of the one pixel in a location corresponding to the one picture element.

8. An image processing method for an image processing device that has a display panel unit to display an image, the display panel unit including: a first liquid crystal panel including a plurality of picture elements; a second liquid crystal panel opposite the first liquid crystal panel and including a plurality of pixels; and a backlight opposite the second liquid crystal panel and having a plurality of light-emitting regions, the image processing method comprising:

generating backlight data from input image data to control outputs of the plurality of light-emitting regions;

increasing an output value for each of the plurality of light-emitting regions specified by the backlight data;

generating luminance distribution data for the backlight from the output value for each of the plurality of light-emitting regions that has been increased;

generating second panel data from the input image data to control aperture ratios of the plurality of pixels;

increasing an aperture ratio for each of the plurality of pixels specified by the second panel data;

generating luminance distribution data for the second liquid crystal panel the luminance distribution data for the backlight and the aperture ratio for each of the plurality of pixels that has been increased; and generating first panel data from the input image data and the luminance distribution data for the second liquid crystal panel to control aperture ratios of the plurality of picture elements.

* * * * *